US005842720A

United States Patent [19]

Ward

[11] Patent Number: 5,842,720

[45] **Date of Patent: *Dec. 1, 1998**

[54] PRESSURE SENSITIVE REINFORCEMENT STRIPS FOR LOOSE LEAF PAGES

[76] Inventor: Gary R. Ward, 9621 Old Bonhomme Rd., St. Louis, Mo. 63132

[ * ] Notice: This patent issued on a continued prosecution application filed under 37 CFR 1.53(d), and is subject to the twenty year patent term provisions of 35 U.S.C. 154(a)(2).

[21] Appl. No.: 707,415

[22] Filed: Sep. 4, 1996

[51] Int. Cl.[6] ..... B42D 1/00

[52] U.S. Cl. ..... 281/21.1; 281/38; 402/79

[58] Field of Search ..... 402/79, 80 R, 402/80 L; 281/21.1, 38, 24, 27.1, 28

[56] References Cited

U.S. PATENT DOCUMENTS 1,769,395 7/1930 Selden .
1,843,771 2/1932 Kline .
2,375,582 5/1945 Pitt .
2,762,372 9/1956 Jochim .
2,764,501 9/1956 Perri .
4,431,325 2/1984 Colby .
4,662,770 5/1987 Block .
4,718,962 1/1988 Goodwin .
4,990,018 2/1991 Best et al. .

*Primary Examiner*—Willmon Fridie, Jr.
*Attorney, Agent, or Firm*—Paul M. Denk

[57] ABSTRACT

A reinforcement in the form of a reinforcing strip is folded longitudinally, into approximately two halves, the two inner contiguous faces of the strip containing pressure sensitive adhesive, and being precut with apertures to align with the apertured edge of a loose leaf sheet, to provide for a double reinforcement when applied to the side edge of such a sheet when inserted in its binder, so as to prevent its premature tearing as a result of frequent usage.

7 Claims, 1 Drawing Sheet

PRESSURE SENSITIVE REINFORCEMENT STRIPS FOR LOOSE LEAF PAGES

BACKGROUND OF THE INVENTION

This invention, as hereinafter described, is primarily for usage for attachment to an accompanying page for insertion in a loose leaf like binder, in general, or for example, a page of an airline pilot's guide, or for that matter, any of the other plurality of pages and sheets that are applied into such binders, and held in place for repeated usage by their owner. Obviously, a variety of reinforcement means, for use upon pages, have long been available in the art, including the simply application of a tape to the edge of a sheet, usually along one side, in order to reinforce it against tearing. In addition, for decades the gum reinforcement circles, formed as annuluses, for placing around holes along the edge of a page, have long been available in the art, for providing and enhancing the reinforcement to the edge of a sheet, particularly those applied to a binder.

There are also a variety of prior patents that disclose related technology, such as can be seen in the patent to Selden, U.S. Pat. No. 1,769,395, which discloses a thin metallic strip that is superimposed over the upper and apertured edge of a loose leaf sheet, to provide it with reinforcement. The patent states that the flexible strip of aluminum is adhesively united to one face of the disclosed sheet.

The United States patent to Kline, U.S. Pat. No. 1,843,771, shows the use of a binding strip, formed as a roll, with the strip being made of any suitable material such as paper or woven fabric, or even tough Kraft paper, and which is applied by means of a gummed surface to an edge of a sheet, or pamphlet, to reinforce it for binding. This particular binding means appears to extend substantially over the surface of the protected sheet, as noted.

The United States patent to Pitt, U.S. Pat. No. 2,375,582, shows another form of reinforcing metal strip that is also applied, or embedded, within the upper surface of a fibrous sheet. Its apertures are aligned with those of the underlying sheet.

The United States patent to Jochim, U.S. Pat. No. 2,762,372, shows a filler having a reinforced perforated edge. This particular patented development, as can be seen, provides means for reinforcing the filler or sheet along its edge, and has its openings apparently aligned, which are then applied into a loose leaf binder.

The United States patent to Perri, U.S. Pat. No. 2,764,501, shows a roll of pressure-sensitive reinforcements, for paper, and which may be applied as a length of reinforcement, for paper sheets, or individually applied, simply through the overlaying of the reinforcements upon the upper surface of the shown sheet. These are similar to the previously described gummed reinforcements that have long been available in the art.

The United States patent to Colby, U.S. Pat. No. 4,431,325, shows a reinforcement for corner mounting holes. This reinforcement means is a three panelled reinforcement, having a pressure sensitive adhesive applied upon two of its faces, and which is then folded over about the corner of a sheet, as noted, to provide it with reinforcement. While this particular development does not disclose a strip that may be applied along the length of the side edge of a sheet, upon both surfaces, it does provide for reinforcement along both the upper and lower surfaces of the corner of a sheet, and having both the sheet and the reinforcement apertures aligned, as noted. This patent also describes that it is primarily used for corner reinforcement of a sheet.

The United States patent to Block, U.S. Pat. No. 4,662,770, shows a pressure sensitive reinforcement tape for loose-leaf sheet. This particular development is apparently a roll of pressure sensitive reinforcement tape, extending for a length almost equivalent to the height or width of a page, as can be seen, and which aligns with the apertures of that page. On the other hand, this reinforcement tape does not fold over upon the backside of the shown sheet.

The United States patent to Goodwin, U.S. Pat. No. 4,718,962, defines a shower curtain repair kit, as noted, comprising individual double reinforced members which overly the top edge of a shower curtain, reinforce its apertures, for preventing further tearing when suspended from the individual hooks. Structurally, and technically, this is a shower curtain repair kit, and does not envision its usage for reinforcing frequently used loose leaf sheets.

Finally, the United States patent to Best, et al, U.S. Pat. No. 4,990,018, provides an adapter assembly for use for modifying a photographic image holding sleeve, including first and second sections, one section that folds over on itself between a fold line, and apparently the first section and part of the under section biasing against the adjacent edge of a photographic image holding sheet, as can be seen. The current invention is not for use with photographic images, nor does the current invention incorporate any type of first and second sections, that are arranged at particular locations along the edge of an image holding sleeve, as defined in this prior art patent.

SUMMARY OF THE INVENTION

This current invention is principally related to reinforcing means, in the form of a tape means, that can be applied to the lateral edges, or other edges, of a sheet frequently used in a loose leaf binder, to provide it with full reinforcement, against tearing. The reinforcement means is for use along the side edge of a loose leaf or other binder held sheet, of the type that includes a series of aligned apertures there through, and are normally applied within the binder, and frequently used, during performance of some procedure, such as, for example, the use of an airline pilot's guide, by the pilots, when flying into and out of various airports throughout the world. When usage is made of pages of this nature, as is readily known to anyone that has flown, particularly in small and private aircraft, the pages of such a manual are usually in disarray, unconnected from their binder, primarily because the page apertures have torn free from the loose leaf rings, due to frequent and continuous usage by the pilot. When usage is made of pages of this nature, and whether it be an airline guide, or other related material, manuals in a shop, and the like, that are applied within a loose leaf type binder, or the like, it does not take to long before the pages begin to tear from their binding, and frequently provide a mass disarray within the binder and make it very difficult for usage and application by the user, particularly under rather trying circumstances, as for example, when a pilot needs to make a quick reference to such materials, when making an approach to an unfamiliar airport at a new location, when landing for the first time. Frequently these pages tear out of the binders, which are a form of loose leaf binder, and make it very difficult to keep these types of pilot guides in proper order, for quick reference, when always immediately needed. Furthermore, anyone who has been around a machine shop or manufacturing plant, and has looked at the manual holding the various specification sheets for job performance tasks, and have seen them laying in disarray around their binder, usually by that time filled with oil and dirt, can readily understand that the permanent retention of such sheets within the loose leaf binder, to keep them organized, and clean for ready usage and reference, is a very desirable attribute. This is something that can be achieved and maintained through the usage of the reinforcement strips of this current invention.

The current invention provides means for solving this particular predicament. Basically, the invention utilizes a strip of pressure sensitive material, such as a tape means, with a pressure sensitive adhesive applied to the inner contiguous surfaces of the folded tape, generally along their outer margins, and which folded tape includes a series of aligned holes or apertures provided along the preferably transparent strip, for quick alignment on both sides of the paper edge, aligning with the apertures already provided along the lateral edge of the sheet to be reinforced, to add reinforcement thereat, and to prevent its tearing. Half of the strip is placed under the page, the holes are lined up, and the adhesive adheres this strip to the under edge of the page, with the holes being properly aligned. Then, the upper half of the strip is folded over, to overly the top of the page, and with its holes being lined up, provides a double reinforcement on both sides of the edge of the page, as noted. It is also envisioned that the entire strip of reinforcing material, rather than just its peripheral edges, may have applied to it the pressure sensitive adhesive, so that the entire strip, when folded over into halves, will tightly adhere against the entire contiguous and lateral edge of the loose leaf sheet, to provide full reinforcement thereat. On the other hand, applying the adhesive of the entire strip makes it a little more difficult to attain the proper alignment of the apertures, than when just the tape edge has an adhesive applied to it, to provide that initial and locating tack of the reinforcing strip to the paper edge, when applied.

The type of tape used herein, preferably, will be of transparent material, and the adhesive will be any one of the usually available pressure sensitive adhesives, such as available from 3M Company, which, when the sheets are marketed, contain an overlying strip that preserves the tackiness of the adhesive, but when the reinforcement means is ready for application, the tape may be removed, the tacky adhesive becomes exposed, so that the apertures of the tape may be readily aligned with the existing apertures at the edge of the sheet, and firmly adhered in place, as previously noted.

It is, therefore, the principal object of this invention to provide a pressure sensitive double reinforcement integral strip for loose leaf pages to provide structural reinforcement to the upper and lower surfaces of the lateral edge of a apertured sheet for application to a loose leaf binder.

Another object of this invention is to provide reinforcement means, in the form of a folded tape, that can be readily applied to the edge of a sheet to thoroughly reinforce it against tearing.

Another object of this invention is to provide a reinforcement means, in the form of a folded tape, prefolded and ready for usage by the user, simply through the tear off of covering strips, and the alignment of its adhesive surface with the apertured edge of the sheet to be reinforced.

Another object of this invention is to provide a reinforcement means that can be facilely applied to the loose leaf page.

Another object of this invention is to provide a reinforced sheet that can be sustained in its hole within a loose leaf binder, and not tear free even after repeated usage.

These and other objects will become more apparent to those skilled in the art upon reviewing the summary of this invention, and the description of its preferred embodiment, in light of its drawings.

DESCRIPTION OF THE PREFERRED EMBODIMENT

Figure 1:
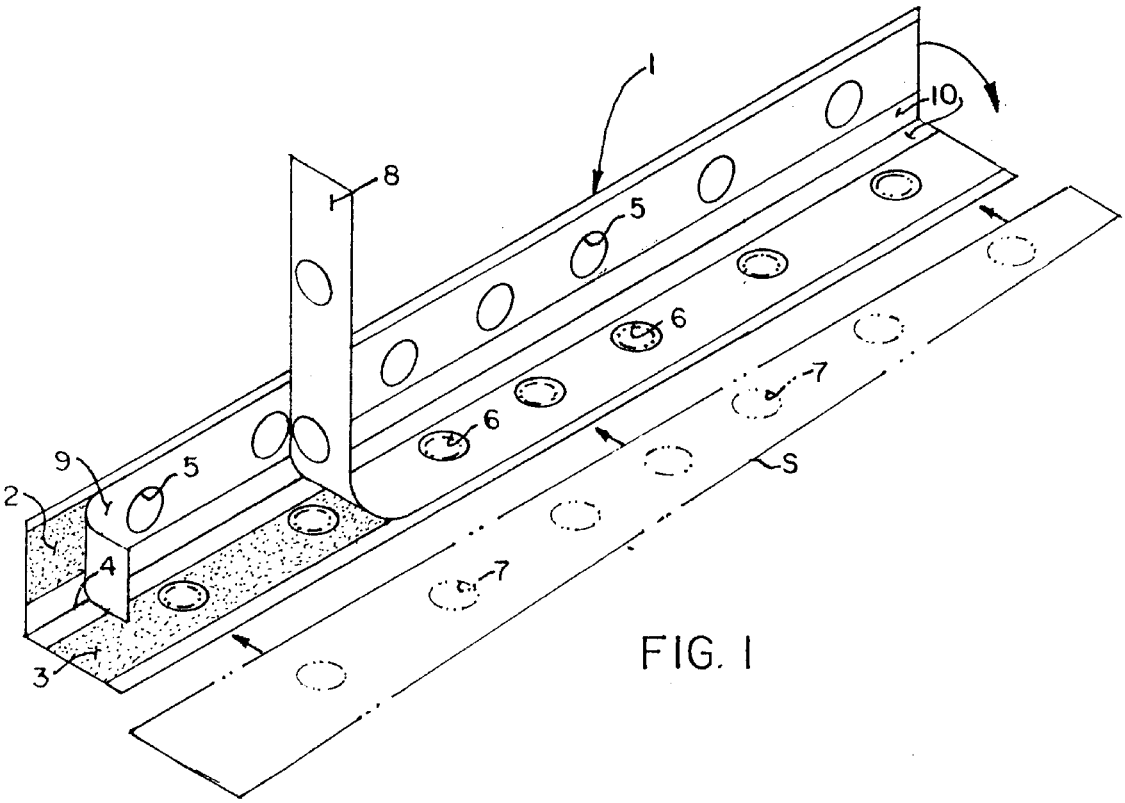
FIG. 1 provides an isometric view of the reinforcement means of this invention, showing its pressure sensitive surfaces being exposed, through removal of their covering tapes, during application to the apertured edge of a loose leaf sheet, the latter being shown in phantom line.

In referring to the drawings, and in particular FIG. 1, the primary reinforcing strip of this invention is readily shown. It includes a reinforcement means formed as a strip, preferably of transparent material, such as a reasonably thick gauge polymer, polyethylene, or cellophane, such as shown at 1, and which has a marginal application of adhesive, as at 2 and 3, extending the length of the strip means, and further incorporating a fold line provided generally along its longitudinal central axis, as noted at 4. Then, a series of aligned apertures or binding holes are provided, as at 5 and 6, equispaced from the described fold line 4, so that these apertures 5 and 6 will conveniently line up, and be aligned, to either side of the corresponding apertures 7, routinely applied within the edge of a loose leaf type of sheet S, as can be seen. Thus, assuming that the loose leaf sheet S described herein is an airline pilot's guide, mechanic's guide, etc., when the reinforcement means of this invention is applied to its sheet, or other frequently used loose leaf held page, the apertures of the strip means will be conveniently precut, arranged at dimensions which are standardized, so that the reinforcing means can be readily applied to both the upper and lower surfaces of the lateral edge of the sheet to be reinforced, and provides not only reinforcement along these upper and lower surfaces, proximate the edge of the sheet, but also at its back edge, along the fold line 4, to prevent any tear from migrating from this edge, inwardly on the sheet, during repeat and frequent usage of the sheets.

Obviously, it is not necessary that the reinforcement means have the identical number of apertures provided there through, as the sheet to be reinforced, just so that at least a plurality of apertures provided in the means will conveniently line up with corresponding apertures provided along the marginal side edge of the page to be reinforced, to provide for usage and application of this development, without any inconvenience, but yet provide the fully enhanced structural strength to the sheet, to prevent its tearing even after frequent and repeated usage.

Figure 2:
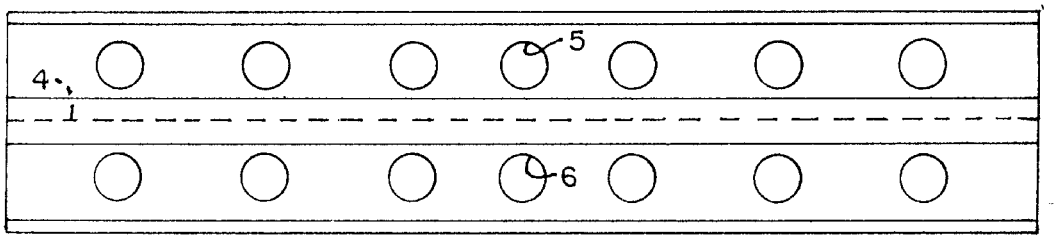
FIG. 2 is a plan view of the reinforcement means of this invention, before its folding.

As can be seen in FIG. 2, the strip has generally equal dimensions to either side of its fold line 4, and that the apertures are arranged in pairs, as noted, and align up with each other, and also with the holes provided through the lateral edge of the sheet to be reinforced, to provide for their facile and quick application of this reinforcing strip to any sheet, to prepare it for prompt usage.

As can be seen from the figures, one-half of the reinforcing means is applied to the one surface of the loose leaf page, their apertures are lined up, and the pressure sensitive adhesive, as at 2 or 3, is pressed against the surface of the contiguous page. Following this, the tape means is folded over, as along its fold line 4, and bent down along the upper side of the page, to align the second row of apertures, with the holes provided through the page, at which time the covering tape 9 will be removed, and the pressure sensitive adhesive 2 exposed, ready for pressing against the upper contiguous surface of the page, to thereby provide for a double reinforcement strip along both side edges of the loose leaf page, to assure its retention within the binder, even after frequent and repeat usage. Obviously, the covering tape 8 will also have been initially pulled free of its adhesive 3, when the strip has been initially applied upon the lower surface of the adjacent loose leaf sheet, and the apertures 6 aligned with the apertures 7, to provide ready application for fully reinforcing the lateral edge of the shown loose leaf sheet.

As previously explained, since these are pressure sensitive type adhesives that are used along the reinforcing strip 1, the covering material 8 or 9, forming the tapes, may be of the usual type of protective material applied to pressure sensitive adhesive, such as glassine, or other type of covering sheet frequently used for this purpose, and it may be previously applied thereon, during the manufacture of these strips, and then stripped free during usage and application of the reinforcing means to the edge of a loose leaf sheet. In addition, while the adhesive is only shown being applied to the approximate marginal edges of the strip, as along its upper and lower margins, as noted, leaving slight gaps 10, it is possible that the pressure sensitive adhesive could be applied over the entire faces of the reinforcing strips, those faces that will be folded over into contiguity, and which, as previously explained, may take a little more dexterity in aligning up their holes, during application, but this would just provide all the further structural reinforcement and strength for the contiguous page, once reinforced with the reinforcing means of this development.

Figure 3:
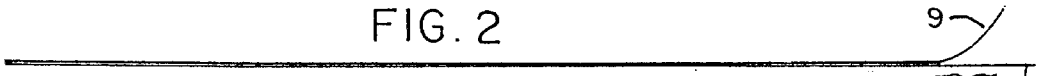
FIG. 3 is a side edge view of the reinforcement means of FIG. 2, showing a covering strip during the process of its removal from the pressure sensitive adhesive along one surface of the tape.
Figure 4:
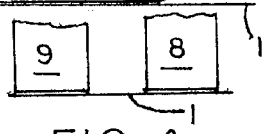
FIG. 4 is a partial right side view of the reinforcement means of FIG. 2 showing the covering tapes being pulled away from the pressure sensitive adhesive of the strip means.
Figure 5:
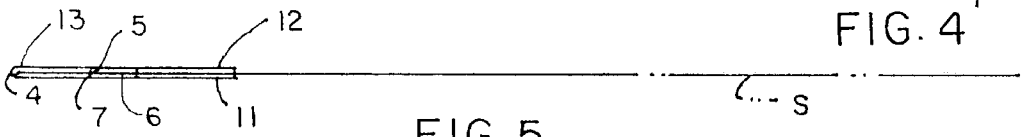
FIG. 5 is an edge view of the reinforcement means applied in place upon a loose leaf sheet to reinforce its apertured lateral edge.
Figure 6:
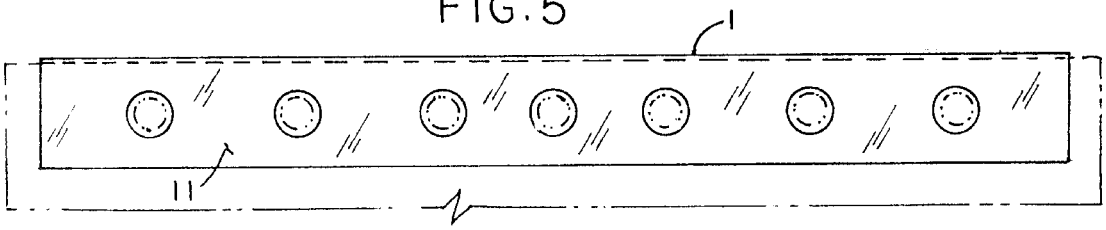
FIG. 6 is a top plan view of the applied reinforcement means shown in FIG. 5.

As can be seen in FIGS. 3 and 4, the covering tapes 8 and 9 are shown being pulled back from their strip means 1, during installation. FIG. 5 discloses the applied reinforcement means, with each half segment of the strip means, as at 11 and 12, being folded over, aligning with the apertures 7, of the loose leaf sheet, and providing full reinforcement upon the upper and lower surfaces of the sheet, in addition to its side edge 13, as along the strip means fold line 4, as noted. FIG. 6 discloses the reinforcement means of this invention, comprising the strip 1 fully located and emplaced in position, along the lateral edge of the sheet, with all of the various apertures being properly and conveniently aligned, so that the fully edge reinforced sheet, having double reinforcement upon both the upper and lower surfaces of the edge of the sheet, being ready for prompt application to the loose leaf binder, which will sustain its retention therein, even after repeat and frequent usage.

Obviously, this type of reinforcement means, formed as a longitudinally folded strip, could be used for other applications, such as by the student, or any other person or business that utilizes a variety of loose leaf binders, for holding sheet material of this type in place, for repetitive usage. These are example of the type of reinforcement strip of this invention, for use during its application, as formed in its various modifications, for use primarily in affording a double reinforcement to the edges of loose leaf sheets bound within a binder.

Variations or modifications to the subject matter of this invention may occur to those skilled in the art upon reviewing the disclosure provided herein. Such variations or modifications, if within the spirit of this invention, are intended to be encompassed within the scope of any claims to patent protection issuing upon this development. The description of the preferred embodiment provided herein, and as shown in its drawings, are set forth for illustrative purposes only.

Having thus described the invention, what is claimed and desired to be secured by Letters Patent is:

1. Reinforcement means for structurally strengthening the lateral edge of a page or sheet, comprising a length of strip means, said strip means being folded over approximately in half along its length, pressure sensitive adhesive applied to the inner contiguous surfaces of said folded strip means, a plurality of apertures provided through the strip means to accommodate its containment within a binder, covering tapes applied over the arranged adhesive, each covering tape covering one-half of the folded strip means, said covering tapes capable of removal when then reinforcement means is prepared for application to the lateral edge of a sheet, whereby said aligned apertures are provided through each half of the folded strip means, to accommodate the emplacement of the strip means as applied to the edge of the sheet into a binder, each pair of aligned apertures also aligning with the holes provided through the edge of the sheet being reinforced, said strip means being formed of a polymer, and said adhesive being a polymer that remains tacky to provide for its attachment to the lateral edge of a sheet, whereby upon application of the lateral edge of a page between the folded double edge reinforced sheet extending up to its fold line provides reinforcement for the sheet and strengthening it to prevent its tearing from a binder.

2. The reinforcement means of claim 1 wherein there are seven pairs of aligned apertures provided through the strip means, and coincide with the apertures provided through the reinforced sheet.

3. The reinforcement means of claim 1 wherein the reinforced sheet comprises a page for application to a loose leaf binder.

4. The reinforcement means of claim 3 wherein the reinforced sheet comprises a page of an airline pilot's guide for application to a loose leaf binder.

5. Reinforcement means for structurally strengthening the lateral edge of a page or sheet, comprising a length of strip means, said strip means being folded over approximately in half along its length, pressure sensitive adhesive applied to the inner contiguous surfaces of said folded strip and only along their outer margins, a plurality of apertures provided through the strip means to accommodate its containment within a binder, said plurality of apertures being made before the reinforcement means is applied to a page or sheet, covering tapes applied over the arranged adhesive, and each covering tape covering approximately one-half of the folded strip means, said covering tapes capable of removal when said reinforcement means is prepared for application to the lateral edge of a sheet, said aligned apertures are provided through each half of the folded strip means and their covering tapes, to accommodate the emplacement of the strip means as applied to the edge of sheet into a binder, each pair of aligned apertures also aligning with the holes provided through the edge of the sheet being reinforced, said strip means being formed of a polymer, and said adhesive being a polymer that remains tacky to provide for attachment of the reinforcement means to the lateral edge of a sheet, whereby said reinforcement means is applied to a page or sheet by the locating of one-half of the strip means under a edge of a page, with their holes lined up, and held in position while the covering tape is removed from the other strip means which is folded over and adhered to the proximate surface of the sheet, with the sheet then being turned over for removal of the covering tape from the other half of the folded strip means and its application by means of the adhesive to the opposite side of the edge of said sheet, thereby providing reinforcement for the page or sheet and strengthening it to prevent its tearing from a binder.

6. The reinforcement means of claim 5 wherein the reinforced sheet comprises a page for application to a loose-leaf binder.

7. The reinforcement means of claim 6 wherein there are seven pairs of aligned apertures provided through the strip means, before its application to a page or sheet, and which aligned apertures coincide with the apertures provided through their reinforced sheet.

* * * * *